US006435367B1

(12) United States Patent
Reutter

(10) Patent No.: US 6,435,367 B1
(45) Date of Patent: Aug. 20, 2002

(54) CLOSING CAP FOR MOTOR VEHICLE RADIATOR

(76) Inventor: Heinrich Reutter, Theodor-Heuss-Strasse 12, D-71336 Waiblingen (DE)

( * ) Notice: Subject to any disclaimer, the term of this patent is extended or adjusted under 35 U.S.C. 154(b) by 0 days.

(21) Appl. No.: 09/555,506

(22) PCT Filed: Dec. 3, 1998

(86) PCT No.: PCT/EP98/07847

§ 371 (c)(1),
(2), (4) Date: Jul. 25, 2000

(87) PCT Pub. No.: WO99/28606

PCT Pub. Date: Jun. 10, 1999

(30) Foreign Application Priority Data

Dec. 3, 1997 (DE) ..... 197 53 597

(51) Int. Cl.[7] ..... B65D 51/16

(52) U.S. Cl. ..... 220/203.07; 220/203.27; 220/203.29; 220/DIG. 32; 236/34.5; 180/68.4

(58) Field of Search ..... 220/303, 304, 220/DIG. 32, 203.23, 203.24, 203.25, 203.26, 203.27, 203.28, 203.29, 203.07, 203.04; 236/34.5; 180/68.4

(56) References Cited

U.S. PATENT DOCUMENTS

| | | | | |
|---|---|---|---|---|
| 3,164,288 A | * | 1/1965 | Boomgaard | 220/DIG. 32 |
| 3,284,004 A | | 11/1966 | MacLennan | |
| 4,511,056 A | * | 4/1985 | Reutter | 220/DIG. 32 |
| 4,872,584 A | | 10/1989 | Sakai | |
| 5,036,888 A | * | 8/1991 | Scharrer et al. | 220/DIG. 32 |
| 5,169,015 A | * | 12/1992 | Burke | 220/DIG. 32 |
| 5,248,052 A | | 9/1993 | Mellinger et al. | |
| 5,522,456 A | * | 6/1996 | Valk | 220/DIG. 32 |
| 5,603,425 A | * | 2/1997 | Breeden | 220/DIG. 32 |
| 5,813,598 A | * | 9/1998 | Kim | 236/34.5 |

FOREIGN PATENT DOCUMENTS

| | | |
|---|---|---|
| DE | 16107 | 12/1958 |
| DE | 1931736 | 11/1965 |
| DE | 2710982 A1 | 9/1978 |
| DE | 4422292 A1 | 12/1995 |
| DE | 29610724 U1 | 3/1997 |
| DE | 19705036 A1 | 8/1998 |
| EP | 0101339 A1 | 2/1984 |
| EP | 0287450 A1 | 10/1988 |
| FR | 1402094 | 5/1965 |
| WO | WO 95/32904 | 12/1995 |
| WO | WO 96/01963 | 1/1996 |

OTHER PUBLICATIONS

Patents abstracts of Japan, 62–159721 A., M–653, Dec. 22, 1987, vol. 11, No. 392.

* cited by examiner

*Primary Examiner*—Nathan J. Newhouse
(74) *Attorney, Agent, or Firm*—Jones, Tullar & Cooper, P.C.

(57) ABSTRACT

The invention relates to a closing cap (10) for the fixed tubing of a motor vehicle radiator, comprising an inner part (14) with a flow connection means between the inside and the outside of the container, as well as a distributing mechanism for freeing and closing the flow connection means. A valve body (22) of the distributing mechanism (11), which can be reciprocated, is compressed under pre-stress towards the inside of the container against a sealing seat (21) at the inner part (14) of the cap, so that said valve body can be lifted from said sealing seat (21) when a threshold value of the pressure inside the container is exceeded. In order to produce a closing cap (10) which does not open in case of overpressure resulting from heat accumulation and which ensures that the container is protected in case of a continuing increase of pressure, in a simple and cost-effective way, the invention provides for in-use controlled adjustment of the pre-stress used for compressing the valve body (22) against the sealing seat (21).

22 Claims, 6 Drawing Sheets

CLOSING CAP FOR MOTOR VEHICLE RADIATOR

FIELD OF THE INVENTION

The present invention relates to a pressure cap for a stationary filler neck of a tank, in particular a motor-vehicle radiator, according to the generic part of Claim 1.

BACKGROUND OF THE INVENTION

In known pressure caps, for example for motor-vehicle radiators, the valve body of the valve arrangement is loaded in a constant manner in such a way that the flow connection between the inside and the outside of the radiator is opened when the pressure inside the radiator exceeds a certain threshold value. This then causes the air containing coolant to escape, Such simple pressure caps facilitate pressure equalization during operation of the motor vehicle when the pressure rises due to heating of the coolant in the radiator and when a critical pressure is exceeded. This is a safety aspect. However, in motor-vehicle radiators, overpressure due to accumulated heat also rises when the vehicle is not running, i.e. when the engine is turned off, and with the above named simple pressure caps, the valve arrangement is also opened completely, which poses the danger that a large amount of coolant escapes or evaporates, or that the radiator may even boil until empty, which means that coolant has to be replenished often. For that purpose, multi-stage pressure caps have been developed (DE 41 07 535 C1) which reduce the overpressure produced by accumulated heat differently than a considerably higher overpressure caused by malfunctioning. However, such a pressure cap is relatively expensive because it contains several contra-rotating valve-body parts and several sealing and counter-sealing surfaces. Furthermore, coolant is spilled in case of overpressure after the vehicle engine is turned off and the pressure is reduced. In that case, an absolute loss of water can be prevented only if an equalizing tank is provided to catch the liquid, or if an additional circulating pump is used which prevents the pressure from rising by circulating the coolant when the engine is turned off. However, this is expensive.

BRIEF SUMMARY OF THE INVENTION

It is therefore the objective of the present invention to create a pressure cap of the type mentioned above, which on the one hand simply and cost-effectively prevents the opening due to overpressure produced by accumulated heat, and which on the other hand ensures that the tank is protected when the pressure rises further.

This objective is reached with a pressure cap of the type mentioned above which has the characteristics named in the detailed description.

The measures according to the invention achieve that the pre-stress exerted on the valve body can be controlled in such a way, depending, for example, on the operation of the motor vehicle, that the pressure cap does not open in case of a defined rate of overpressure produced by accumulated heat. This prevents the escape of air mixed with coolant during that "operating phase". Additional components such as equalizing tanks or circulating pumps are not required. Overpressure can be reached by cooling the vehicle's radiator during standstill. However, the pressure cap will open while the pressure rises above a certain safety threshold, to ensure that the cooling system is not damaged by bursting or leakages including the connector hoses. For example, the pre-stress means can be adjusted to two stages, i.e. to an opening pressure according to normal operation and a higher opening pressure which responds to pressure increase in case of accumulated heat.

The pre-stress means for the valve body can be controlled in various ways, according to the characteristics named in the detailed description. If the pre-stress means is controlled by negative pressure or overpressure, the set point can be picked up directly from the engine compartment of Otto engines or diesel engines. On the other hand, if an electrical signal is to be provided, it can be directly triggered, for example, when the ignition is on.

A preferred design for the pre-stress means of the valve body results from the characteristics named in the detailed description.

The power between the drive and the pressure piece [Druckstück] can be transmitted either directly or via a power transmission element, i.e. a type of transmission gear. Furthermore, it is possible to have a straight-line connection or a connection via an element reversing the drive direction. Preferred designs of the element reversing the drive direction are named in the detailed description.

The type and design of the drive can also vary, as is shown by the characteristics in the detailed description.

In a particularly advantageous way, the drive can be accommodated in the cover handle. A combination of the pressure cap and a safety device to prevent release at excess temperature is apparent from the detailed description.

Further details of the invention are described below, where the invention is described with reference to the embodiments shown in the drawings. The drawings show:

DETAILED DESCRIPTION OF THE INVENTION

Figure 1:
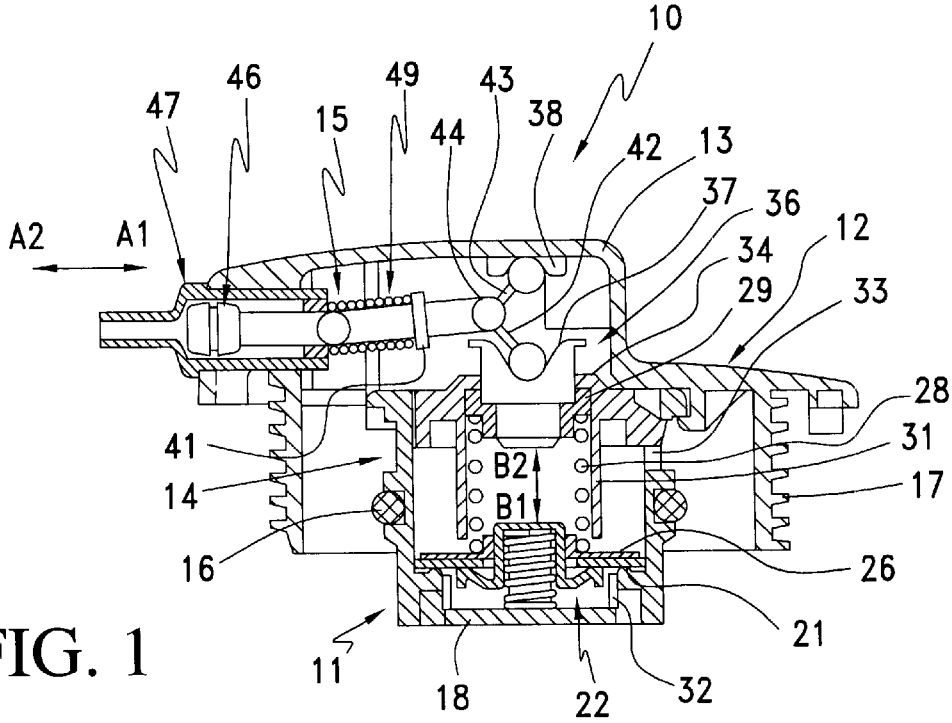
FIG. 1 and 2 a diagrammatic longitudinal sectional view of the pressure cap for motor vehicle radiators according to a first embodiment of the present invention in a first and second active position, respectively, FIGS. 3 and 4 a view corresponding to that in FIG. 1 and 2, but according to a second embodiment of the present invention and FIGS. 5 and 6 a view corresponding to that in FIG. 1 and 2, but according to a third embodiment of the present invention.

The pressure cap 10 or 10' or 10" or 10'" shown in the drawings by means of three embodiments is provided with an overpressure valve arrangement 11 and is controlled in such a way that the opening pressure of the overpressure valve arrangement 11 can be adjusted to two steps by means of a drive 15, 15', 15" or 15'", namely to an opening pressure taking into account the motor vehicle radiator overpressure at normal operation, and to an opening pressure which results from the development of accumulated heat when the vehicle engine is Turned off.

Figure 2:
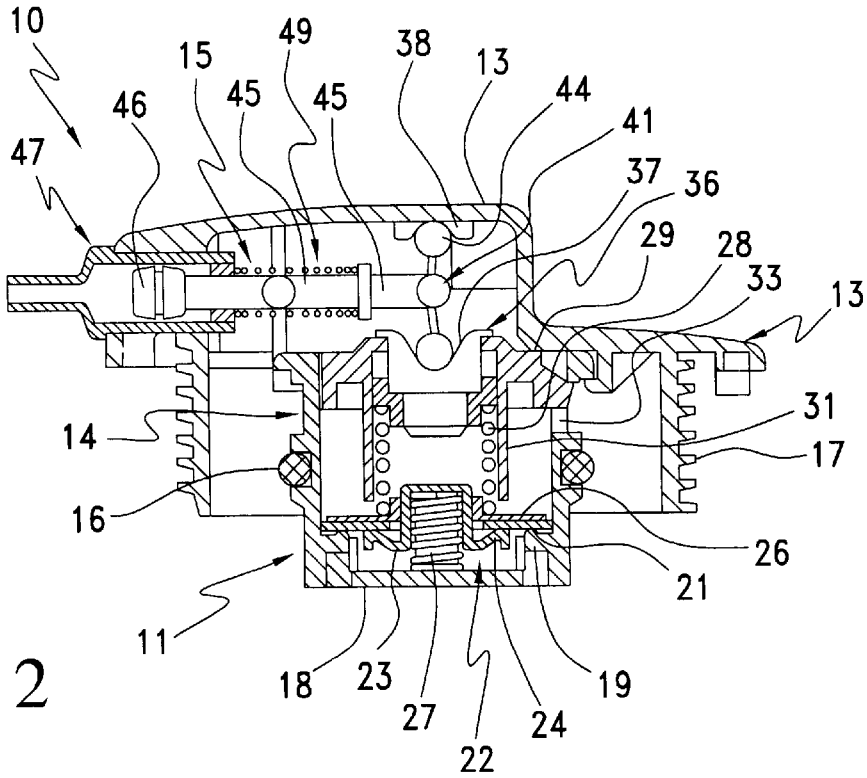
Figure 7:
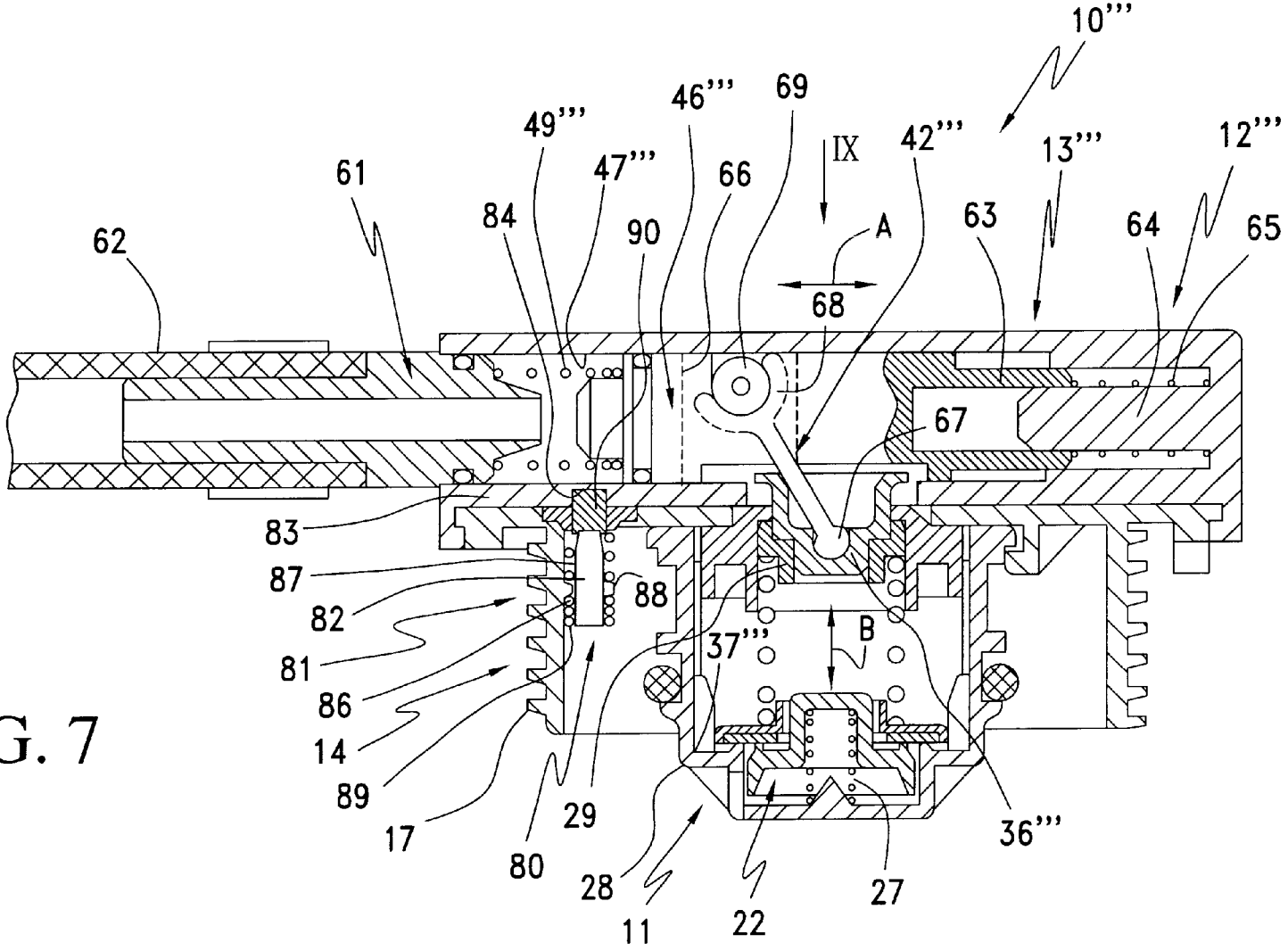
FIGS. 7 and 8 a view corresponding to that in FIG. 1 and 2, but according to a fourth embodiment of the present invention and, FIGS. 9 and 10 a top plan view, partly in a section according to arrow IX in FIG. 7 and according to line X—X in FIG. 9, respectively.
Figure 8:
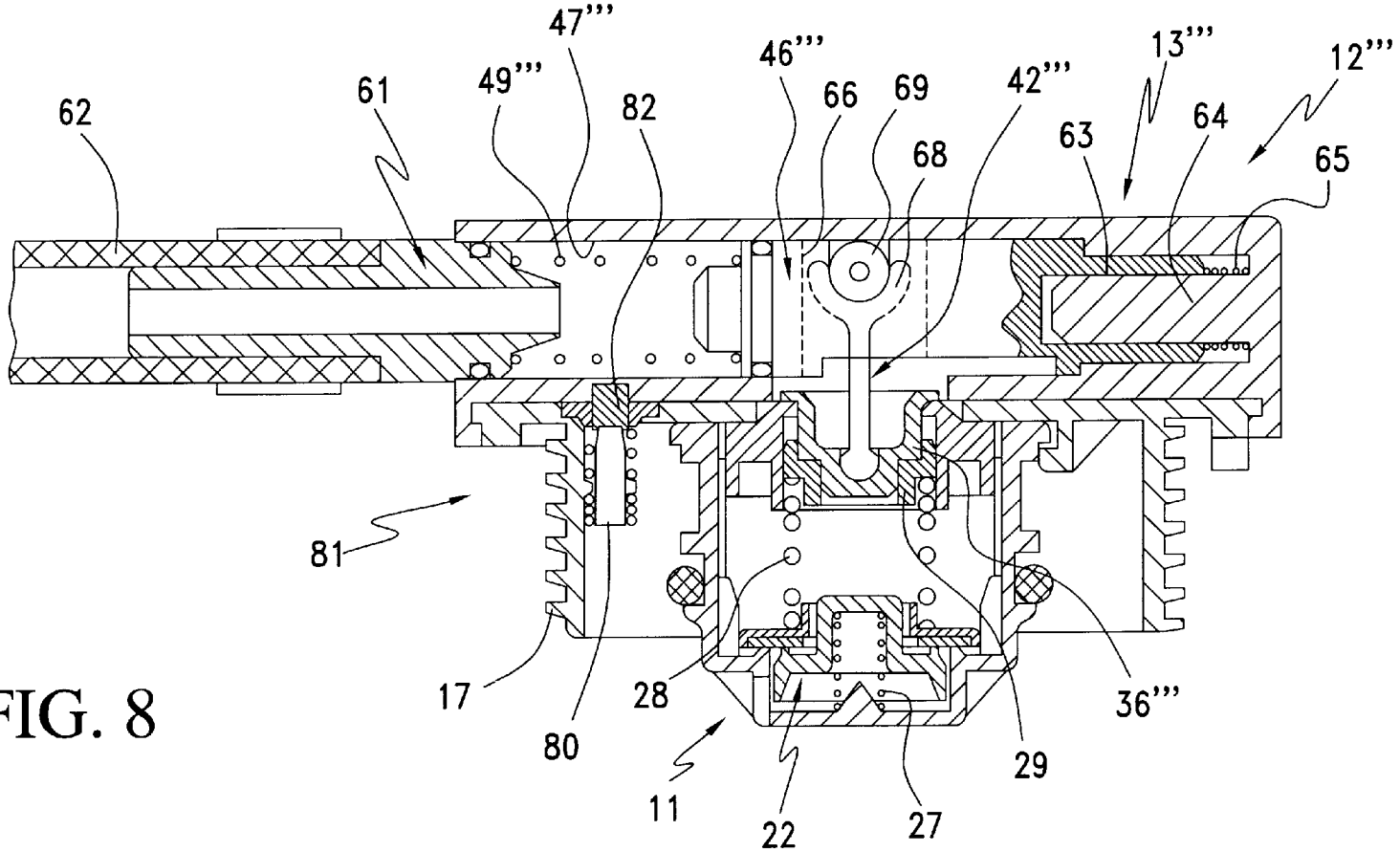

According to FIG. 1 and 2, the pressure cap 10 has an outer part 12 with a handle 13 and an outer threaded part 17 for screwing and unscrewing the pressure cap 10 to and from the opening of a motor vehicle radiator (not shown) or other tank, and an inner part 14 which can be inserted via an O-ring 16 as a seal into the filler neck of the motor vehicle radiator or other tank. The outer part 12 is connected to the inner part 14 either rigidly or lockably and rotatably, by an anti-rotation means (not shown here) that responds either to pressure or to temperature (FIG. 7 and 8). It goes without saying that the outer part 17 can also be provided with a bayonet connection.

The cylinder-shaped inner part 14 of pressure cap 10 is equipped with overpressure valve arrangement 11. It has a bottom 18 and above the bottom a ring edge 19 extending inward, whose Top section is provided with a sealing seat 21 for a valve body 22 of overpressure valve arrangement 11. The valve body 22 has a central hat-shaped part 23 on whose peripheral flange 24 rests a washer 26. The hat-shaped part 23 is supported at the bottom 18 by a spring support 27. The washer 26 is affected by a pressure spring 28 or overpressure valve spring which is supported at the other end in a sleeve 29 which is guided (moving up and down in axial direction) inside a guide cylinder 34 which has an axial stop 31 for sleeve 29. The guide cylinder 31, which also accommodates pressure spring 28, is fastened to that end of inner part 14 that is facing away from the valve body 22, and it ends a short distance before washer 26. Thus, the guide cylinder 31 limits any possible opening movement of washer 26 or valve body 22. Provided between bottom 18 and the inner part 14 are openings 32 leading into inner part 14 of the motor vehicle radiator or other tank. The inner part 14 also has openings 33 on the outer periphery and opposite guide cylinder 31 whose diameter is smaller; these openings 33 are in contact with the outside air. When the valve body 22 is lifted off the sealing seat 21, a flow connection is established between the inside of the radiator or other tank and the outside air.

Movably accommodated in sleeve 29 is a pressure piece 36 whose other end extends into a chamber 39 between outer part 12 and inner part 14 where it has an articulated receptacle 37. Provided opposite articulated receptacle 37 of pressure piece 36, on the inside of handle 13, is a stationary articulated receptacle 38. The pan-like articulated receptacles 37 and 38 accommodate the cylindrical or spherical ends of a lever arm 42 or 43 or a toggle 41 which together with pressure piece 36 forms a reversal of movement or power. Connected to joint 44 of toggle 41 is a rod 45 of a piston 46 of drive 15 which is movable back and forth within a clutch cylinder 47 according to double arrow A. The piston rod 46 is provided with a centre joint 48 and surrounded by a control spring 49, which is supported on one end by a collar 41 of piston rod 45 and on the end by the inner end of clutch cylinder 47. The outside of clutch cylinder 47 is shaped like a sleeve in such a way that it can be connected to a hose (not shown) which represents the negative-pressure line and leads directly or indirectly to the engine compartment.

The control of the overpressure valve arrangement 11 of pressure cap 10 functions as follows: When the clutch cylinder 47 is latched into chamber 39 of handle 13 of pressure cap 10, the control spring 49 is mechanically pre-stressed, so that the spring presses piston rod 45 inward, as shown in FIG. 2, and moves toggle 41 in the direction of arrow A1. When the two lever arms 42 and 43 of toggle 41 spread out at an angle, pressure piece 36 is moved in the direction of arrow B1, thus pre-stressing the overpressure valve spring 28. In this manner, valve body 22 is provided with increased opening pressure.

Since negative pressure develops when the vehicle engine is started, piston 46 is pulled in the direction of arrow A2., which causes piston rod 45 to pull back the toggle 41, as shown in FIG. 1. Thus, under the effect of the pressure spring 28, the pressure piece 36 is moved upward in the direction of arrow B2, so that the pressure spring 28 is somewhat released. This results in a lower opening pressure for valve body 22, which is normally set at about 1.4 bar. When the vehicle engine is turned off, there is no more negative pressure at piston 46, which means that the control spring 49 can move toggle 41 back in the direction of arrow A1, namely to a stop which lies before dead centre. In that manner, the overpressure valve spring 28 is tight again, resulting in an opening pressure for valve body 22 (according to FIG. 2) that is increased to, for example, 2.0 bar. Now the valve body 22 can withstand the internal pressure of the radiator or other tank which results from the accumulated created when the engine is turned off.

When the clutch cylinder 47 is geared down to open pressure cap 10, for example for replenishing coolant, control spring 49 is released all the way, so that the overpressure valve spring 28 switches by means of its own force as described above to the normal-mode opening pressure such as 1.4 bar. If after the pressure cap is screwed on again, the clutch cylinder 47 is inadvertently not connected to pressure cap 10, the lower normal-mode opening pressure is automatically maintained, so that the motor vehicle can be operated as before.

According to other non-illustrated embodiments of the present invention, drive 15 can be formed, for example, by an appropriately charged membrane such as a domed membrane instead of the piston cylinder arrangement, and/or the pre-stress means can be controlled by overpressure through an appropriate change of the drive and the power-transmission element.

Figure 3:
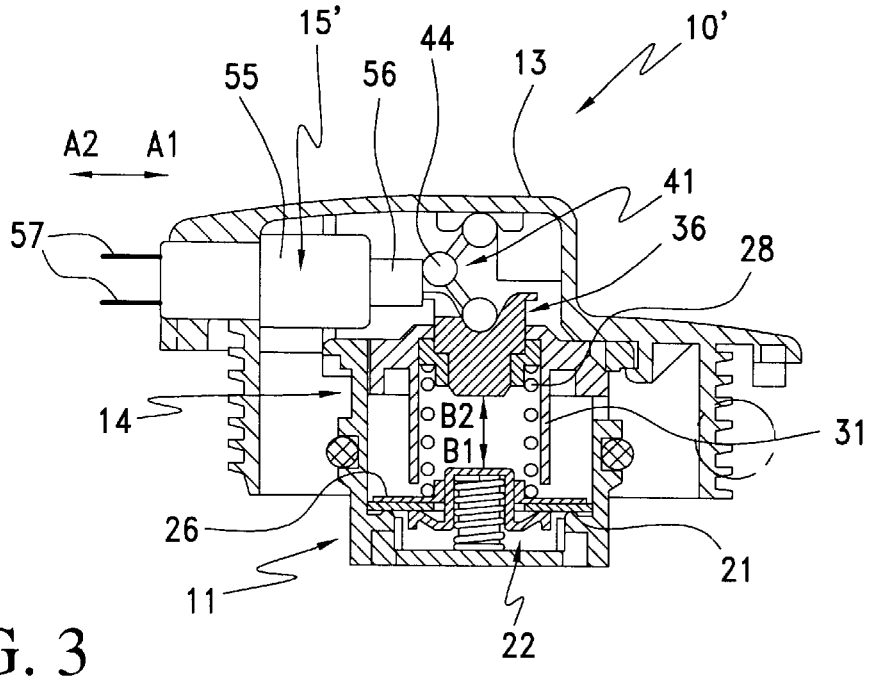
Figure 4:
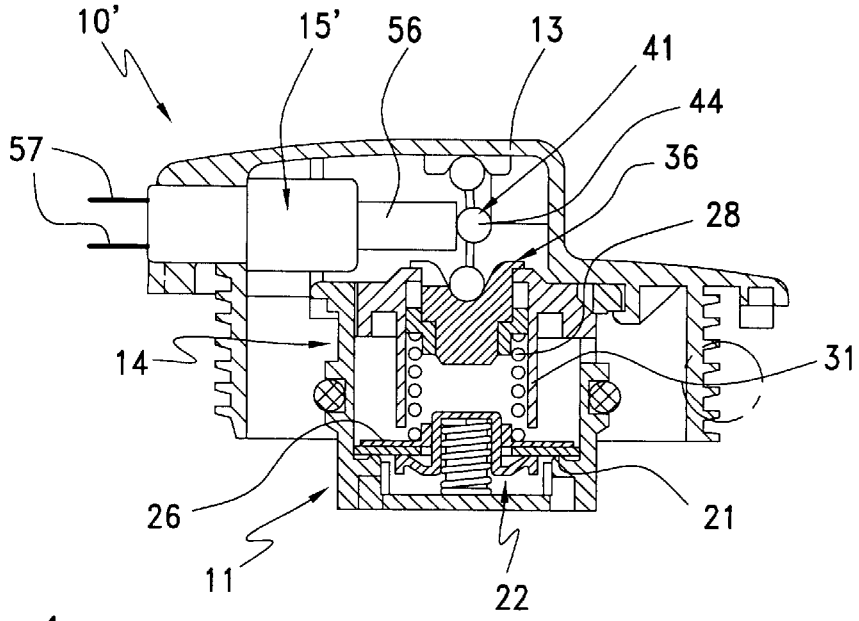

FIG. 3 and 4 show an embodiment of the present invention in which the piston cylinder arrangement (drive 15) controlled by negative pressure is replaced by an electrically controlled lifting magnet (drive 15'). The other components of pressure cap 10' are identical to those of the embodiment according to FIG. 1 and 2, which means that corresponding reference numbers must be used. The tappet 56 of electrically controllable lifting magnet 55 is directly connected to joint 44 of toggle 41. The function is as follows: The overpressure valve 11 has the basic setting of normal-mode opening pressure such as 1.4 bar. After the pressure cap 10' provided with lifting magnet 55 has been screwed onto the vehicle radiator or other tank, contacts 57 of lifting magnet 55 are electrically connected to a control system such as the ignition. This electrical connection causes a lift movement of lifting magnet 55 in the direction of arrow A1 and thus a movement of toggle 41 in that direction, whereby tappet 56 or joint 44 is led up to a stop beyond dead centre, as shown in FIG. 4. This results in a higher opening pressure, such as 2.0 bar, for valve body 22 due to the tightened pressure spring 28.

When the motor vehicle engine is started, lifting magnet 55 receives a control signal via a relay, which causes it to be pulled back, also pulling back toggle 41. Overpressure valve spring 28 is released due to its inherent force, which means that valve body 22 has reached normal-mode opening pressure again.

When the vehicle engine is turned off, lifting magnet 55 received a control signal via the relay in question, so that the position according to FIG. 4 is reached again and the internal pressure of the tank, increased by accumulated heat, is intercepted.

If the electric connection is pulled off to open pressure cap 10', lifting magnet 55 released toggle 41 due to its lifting movement in the direction of arrow A2, so that the overpressure valve spring assumes its position with the lower normal-mode opening pressure. This applies correspondingly if it is inadvertently forgotten to connect lifting magnet 55 electrically with the control relay when pressure cap 10' is screwed on.

In the embodiments shown in FIG. 3 and 4, the electrically controlled lifting magnet 55 can be replaced by an electrical drive 15' in the form of an electric motor whose threaded drive spindle is coupled in a drive-friendly manner with a parallel toothed rack or a coaxial threaded sleeve, which toothed rack or threaded sleeve is connected to joint 44 of toggle 41 at the end facing away from the drive spindle.

In the embodiments shown in FIG. 1 and 2 or 3 and 4, drive 15 or 15' is arranged in a position perpendicular to the extent of pressure spring 28, and its circumference protrudes from handle 13 of pressure cap 10.

Figure 5:
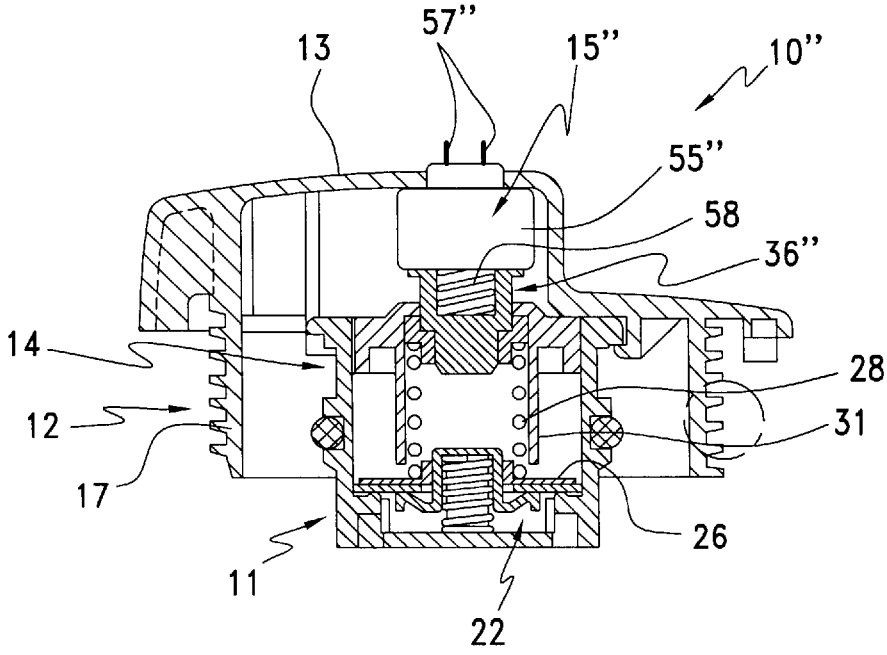
Figure 6:
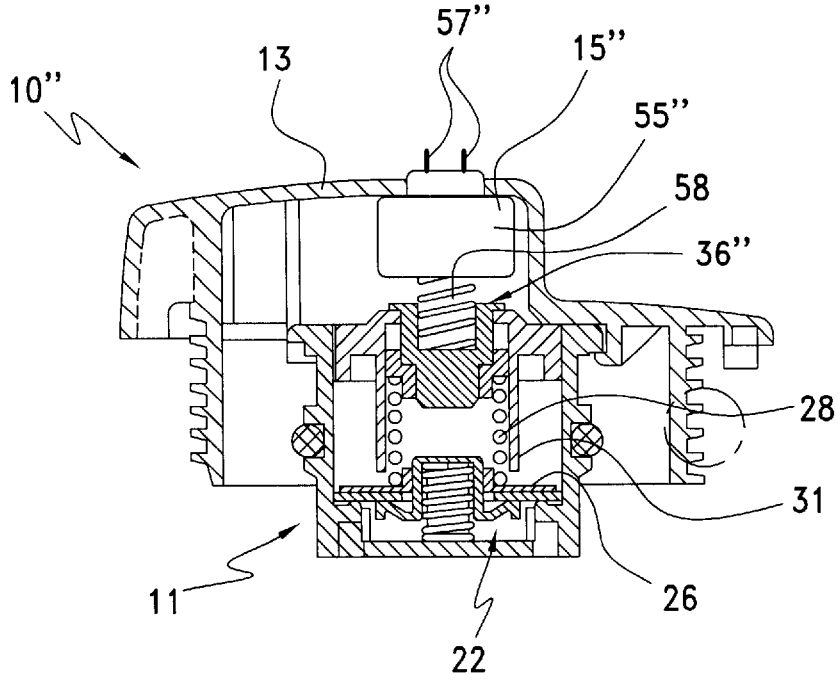

In the embodiment of the present invention shown in FIG. 5 and 6, drive 15" is arranged flush, i.e. axially aligned concentrically with pressure spring 28, and it protrudes at the front of handle 13 of pressure cap 10". Thus, in this embodiment, there is no toggle, which means that drive 15" acts directly upon pressure piece 36" and engages in same. In this embodiment, drive 15" is a rotatable lifting magnet 55" whose electrical contacts 57" lead outside and whose threaded spindle 58 engages in the correspondingly formed pressure piece 36". Otherwise, this embodiment works as described for the embodiment according to FIG. 3 and 4.

It goes without saying that a rotatable lifting magnet can also be used in the embodiment according to FIG. 3 and 4, and that a simple lifting magnet can also be used in the embodiment according to FIG. 5 and 6.

If in the embodiments according to FIG. 1 to 5 a toggle 41 is used as the power transmission element, it goes without saying that other power transmission elements such as eccentric cams, etc. can be used as well.

The fourth embodiment illustrated in FIG. 7 to 10 shows a pressure cap 10'" with a design similar to that of pressure cap 10 according to FIG. 1 and 2. In this embodiment, handle 13'" of the outer part 12'" of pressure cap 10'" is provided with a horizontal cylinder recess 47'" which can be pressure-sealed at its open end by means of an easily removable coupling element 61 to which a hose 62 is connected. Inside cylinder recess 47'" , a piston 46'" moves back and forth in the direction of the double arrow A. Between coupling element 61 and the opposite end of piston 46'" a control spring 49'" is provided. The end 63 of piston 46':, which faces away from coupling element 61, runs through a hollow cylinder—provided by a blind hole drilled in—and via a coaxial cylindrical projection 64 at the other end of handle 13'". Projection 64 is surrounded by a pressure spring 65 supported on one end by end 63 of piston 46'" and on the other end inside handle 13'". In a longitudinally central sector. a lever 42'" is in a slot-shaped recess 66 of piston 46'". End 67 of lever arm 42'", which protrudes from piston 46'" toward inner part 14, is pivotably arranged in a recess 37'" of pressure piece 36'". As in the first embodiment, pressure piece 36'" is supported by pressure sleeve 29 which in turn presses against valve body 22 via pressure spring 29. The inner U-shaped end 68 of lever arm 42'" surrounds a transverse stationary bearing pin 69 arranged close to the top section of the cylinder wall which faces away from pressure piece 36'". It goes without saying that instead of the bearing pin, a bearing ball can be provided to support a corresponding cap of lever 42'". Lever 42'" creates a power-transmitting and direction-changing connection between piston 46'" and pressure piece 36'", so that (as shown in FIG. 7 and 8) when piston 46'" moves as indicated by double arrow A, pressure piece 36'" is moved in the direction of double arrow B, as in the embodiments described above. The function of this embodiment is the same as that of the embodiment shown in FIG. 1 and 2, i.e. the position shown in FIG. 7 results when negative pressure exists while the engine is running and also when coupling element 61 is removed from cylinder recess 47'", while the position shown in FIG. 8 results if the engine was just turned off leading to excessive temperature or overpressure.

Figure 10:
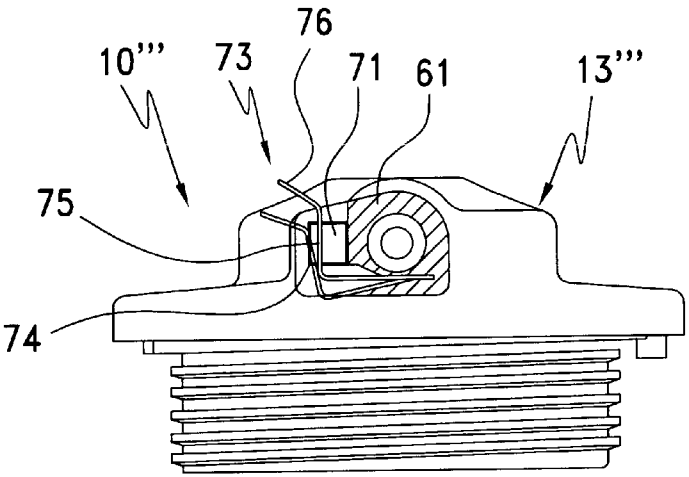
Figure 9:
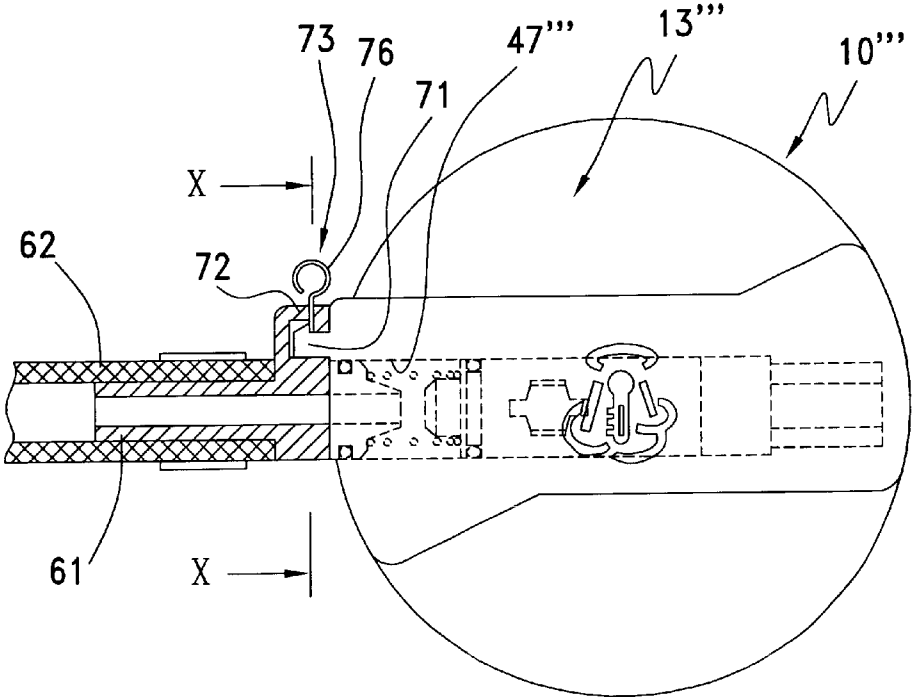

FIG. 9 and 10 show an embodiment of an easily releasable locking means for the coupling element 61 (provided with hose 62) on handle 13'" or in cylinder recess 47'". According to this, handle 13'", as an extension of cylinder recess 47'" has on the outside a protruding hook 71 across which a finger 72 on coupling element 61 catches and locks. Fastened to coupling element 61 is a wire spring 73, the central section of which engages in a slot 75 of hook 71 when the spring is in a released state. By applying pressure to the free end 76 of wire spring 73, it, or its central section 74, can be moved out of slot 65 in hook 71, so that the coupling element 61 can come free of handle 13'" When coupling element 61 is plugged into cylinder recess 47'", piston 46'" is placed into the position shown in FIG. 8, but piston 46'" is returned to the position shown in FIG. 7 when coupling element 61 is uncoupled from handle 13'".

During this, control spring 49'" remains at the corresponding end of piston 46'".

FIG. 7 and 8 also show pressure cap 10'" in combination with an anti-rotation means 80, which responds to temperature, between outer part 12'" and an engagement element 81 (provided with an outer threaded part 17), to which overpressure valve arrangement 11 is connected. Anti-rotation means 80 is provided with a coupling element in the form of a coupling pin 82 arranged inside engagement means 81 on a section of the circumference. Opposite the axially movable coupling pin 82, a blind hole 84 is drilled axially into a wall 83 of handle 13'". To provide the anti-rotational coupling of handle 13'" and engagement element 81, the corresponding end 90 of coupling pin 82 is inside blind hole 84. In that position, pressure cap 10'", can be removed from the radiator's filler neck. Coupling pin 82 can move up and down thanks to a bearing ring 88 held in engagement element 81 and is affected by a control arrangement that responds to temperature and which consists of a memory spring 86 and a back-pressure spring 87. Memory spring 86 is supported at one end by the underside of this bearing ring 88 and at the other end by a shoulder 89 of coupling pin 82. On the other hand, back-pressure spring 87 is supported on the opposite upper side of bearing ring 88 and engagement element 81. If the memory spring expands at a temperature that is too high for the pressure cap to be removed, coupling pin 82 is moved downward until its end 90 comes out of blind hole 84. This uncoupling allows handle 13" to perform a hollow turn in relation to engagement element 81.

Furthermore, such a pressure cap can also be used for equalizing tanks of cooling or heating systems, etc.

What is claimed is:

1. Pressure cap for a stationary finer neck of a tank, comprising:

an inner part of the cap defining a sealing seat and including:

a flow connection between the inside of the tank and the outside of the tank;

a valve argument for releasing and blocking said flow connection, said valve arrangement having a movable valve body, adjustable pre-stress means engaging said movable valve body to bias said movable valve body due to the pre-stress toward said sealing seat; and a toggle for adjusting said adjustable pre-stress means, wherein said movable valve body is pressed by said adjustable pre-stress means against said sealing seat, and wherein when a threshold value of the interior pressure of the tank is reached, said movable valve body is lifted off said sealing seat against the bias of said adjustable pre-stress means.

2. Pressure cap according to claim 1, wherein said adjustable pre-stress means is controlled by negative pressure.

3. Pressure cap according to claim 1, wherein said adjustable pre-stress means is controlled by overpressure.

4. Pressure cap according to claim 1, wherein said adjustable pre-stress means is controlled electrically.

5. Pressure cap according to claim 1, further comprising:

a cap element; and an engagement element, wherein said engagement element is rotatable in relation to said cap element and both elements are locked against rotation with respect to one another at a normal temperature by means of a coupling element, and wherein said coupling element uncouples said cap element and said engagement element at a temperature that is too high for the pressure cap to be safely removed.

6. Pressure cap according to claim 1, wherein said adjustable pre-stress means comprises a spring whose pre-stress is changeable.

7. Pressure cap according to claim 6, the inner part of the cap further includes:

a pressure piece; and a controlled drive, wherein said spring at its end facing away from said movable valve body is supported by said pressure piece which is axially movable by means of said controlled drive.

8. Pressure cap according to claim 7, wherein said controlled drive has a drive direction wherein said toggle serves for reversing said drive direction, and wherein said toggle is provided between said pressure piece and said controlled drive.

9. Pressure cap according to claim 7, wherein said toggle comprises one lever that is stationary, another lever that is supported by said pressure piece, and a joint that is connected to said controlled drive.

10. Pressure cap according to claim 7, wherein said controlled drive is formed by one of: a lifting magnet, an electric drive or a rotatable lifting magnet.

11. Pressure cap according to claim 7, wherein said controlled drive is provided with an electric motor with a threaded spindle and, derived therefrom, a movable toothed rack or threaded sleeve.

12. Pressure cap according to claim 7, wherein said cap has an outer part with a handle and said controlled drive is held in the radial or axial direction on said handle.

13. Pressure cap according to claim 7, wherein said toggle is provided between said pressure piece and said controlled drive.

14. Pressure cap according to claim 13, wherein said toggle comprises a simple lever which is supported at one end by said pressure piece, and at the other end by said controlled drive.

15. Pressure cap according to claim 14, wherein said controlled drive is formed by a piston/cylinder unit.

16. Pressure cap according to claim 15, wherein at one end of said piston of the piston/cylinder unit is held between two springs and in the middle is provided with a bearing for the pivotable accommodation of one end of said simple lever.

17. Pressure cap according to claim 15, wherein said controlled drive is connected to a pressure hose.

18. Pressure cap according to claim 17, wherein said cylinder of said piston/cylinder unit is closed by a manually removable and connectable hose coupling element.

19. Pressure cap according to claim 18, further comprising:

a manually movable locking spring to lock said connectable hose coupling element in place.

20. Pressure cap for a stationary filler neck of a tank comprising:

a movable pressure piece, a movable valve body, a spring coupling said movable pressure piece and said movable valve body, a drive comprising a piston/cylinder unit, and a toggle comprising a bearing and a simple lever wherein said bearing and said simple lever couples said movable pressure piece and said piston of said piston/cylinder unit.

21. Pressure cap for a stationary filler neck of a tank comprising:

a movable pressure piece, a movable valve body, a spring coupling said movable pressure piece and said movable valve body, and a drive coupled to said movable pressure piece, said drive comprising a lifting magnet or rotatable lifting magnet.

22. Pressure cap for a stationary filler neck of a tank comprising:

a movable pressure piece, a movable valve body, a spring coupling said movable pressure piece and said movable valve body, and a drive coupled to said movable pressure piece, said drive comprising an electric motor with a threaded spindle, a movable toothed rack or threaded sleeve.

* * * * *

UNITED STATES PATENT AND TRADEMARK OFFICE

CERTIFICATE OF CORRECTION

PATENT NO. : 6,435,367 B1
DATED : August 20, 2002
INVENTOR(S) : Heinrich Reutter It is certified that error appears in the above-identified patent and that said Letters Patent is hereby corrected as shown below:

Column 6,
Line 62, “finer” should be -- filler --.

Column 7,
Line 1, “argument” should be -- arrangement --.

Signed and Sealed this

Thirty-first Day of December, 2002

JAMES E. ROGAN
*Director of the United States Patent and Trademark Office*